US011680397B2

(12) United States Patent
Ahuja

(10) Patent No.: US 11,680,397 B2
(45) Date of Patent: Jun. 20, 2023

(54) KITCHEN SINK DRAIN STOPPER AND STRAINER

(71) Applicant: PF Waterworks LP, Houston, TX (US)

(72) Inventor: Sanjay Ahuja, Katy, TX (US)

(73) Assignee: PF Waterworks LP, Houston, TX (US)

( * ) Notice: Subject to any disclaimer, the term of this patent is extended or adjusted under 35 U.S.C. 154(b) by 20 days.

(21) Appl. No.: 17/355,916

(22) Filed: Jun. 23, 2021

(65) Prior Publication Data

US 2021/0395986 A1 Dec. 23, 2021

Related U.S. Application Data

(60) Provisional application No. 63/043,124, filed on Jun. 23, 2020.

(51) Int. Cl.
*E03C 1/262* (2006.01)
*A47K 1/14* (2006.01)
*E03C 1/23* (2006.01)

(52) U.S. Cl.
CPC ..... *E03C 1/262* (2013.01); *A47K 1/14* (2013.01); *E03C 1/2306* (2013.01)

(58) Field of Classification Search
CPC ..... E03C 1/262; E03C 1/2306; A47K 1/14
See application file for complete search history.

(56) References Cited

U.S. PATENT DOCUMENTS 3,220,695 A 11/1965 Downey et al.
3,366,980 A 2/1968 Petursson et al.
3,428,295 A 2/1969 Downey et al.
3,453,667 A 7/1969 Politz
4,007,500 A 2/1977 Thompson et al.
4,232,407 A 11/1980 Williams
4,359,788 A 11/1982 Liou
4,432,568 A 2/1984 Ohannesian et al.
5,165,118 A 11/1992 Cendrowski
5,265,281 A 11/1993 McAlpine
5,271,108 A * 12/1993 Wicke ..... E03C 1/26 4/292
5,369,815 A 12/1994 Martin
6,880,179 B2 * 4/2005 Wang ..... A47K 1/14 4/286
7,480,954 B1 1/2009 Houck
9,021,621 B2 5/2015 Booker, Jr.
9,060,656 B2 * 6/2015 Tong ..... E03C 1/23
9,790,673 B2 10/2017 Scott et al.
10,174,488 B1 * 1/2019 Yeh ..... A47K 1/14
10,240,329 B2 3/2019 Beck et al.
(Continued)

*Primary Examiner* — Janie M Loeppke
(74) *Attorney, Agent, or Firm* — Stephen S. Hodgson

(57) ABSTRACT

A drain stopper and strainer for a kitchen sink has a cap, a cap seal, an open-close mechanism, a strainer connected to a lower end of the open-close mechanism with an easy-connect mechanism, and an annular seal engaged with the strainer that seals an annular space between the strainer and a drain fitting. The cap seal preferably seals against the strainer. The stopper/strainer can be pushed into and pulled out of the drain fitting without assembly or disassembly. The strainer can be easily disconnected for cleaning and can be easily reconnected afterwards. For a drain fitted with a garbage disposal unit, the strainer has a hub-and-spoke structure for preventing eating and cooking utensils from falling into the garbage disposal unit.

27 Claims, 4 Drawing Sheets

(56) References Cited

U.S. PATENT DOCUMENTS

| | | | | |
|---|---|---|---|---|
| 10,301,803 | B2 | 5/2019 | Beck et al. | |
| 10,519,637 | B2 * | 12/2019 | Childs | E03C 1/182 |
| 10,563,386 | B2 | 2/2020 | Schuster | |
| 11,162,251 | B2 | 11/2021 | Beck et al. | |
| 2016/0130793 | A1 * | 5/2016 | Lesmeister | E03C 1/264 4/287 |
| 2019/0167043 | A1 | 6/2019 | Beck et al. | |
| 2020/0011038 | A1 | 1/2020 | Ahuja et al. | |
| 2021/0207351 | A1 | 7/2021 | Ahuja et al. | |

* cited by examiner

KITCHEN SINK DRAIN STOPPER AND STRAINER

CROSS REFERENCE TO RELATED APPLICATIONS

This application claims priority to U.S. Provisional Patent Application Ser. No. 63/043,124 filed on Jun. 23, 2020, which is incorporated by reference. This application is related to U.S. patent application Ser. No. 15/584,032, filed May 2, 2017, and Ser. No. 16/558,262 filed on Sep. 2, 2019, each of which is incorporated by reference.

BACKGROUND OF THE INVENTION

1. Field of the Invention

This present invention pertains to a drain assembly used to retain fluid in and release fluid from a kitchen sink and more particularly to a drain stopper and strainer for a kitchen sink.

2. Description of the Related Art

There are a number of types of drain systems or assemblies for retaining water in and then draining water from a kitchen sink. A drain pipe is sealed in a drain opening using a drain flange that is sealed to the sink around the opening. A kitchen sink often has a garbage disposal, which is an apparatus connected to the sink that grinds food waste using an electric motor and a grinding device for passing the waste into the drain pipe. The kitchen sink often has two tubs, where one tub has a drain stopper and strainer, and the other tub has a garbage disposal. U.S. Pat. No. 5,369,815, issued to Martin and titled "Sink Strainer Having a Detachable Seal," is one example of a prior art drain stopper and strainer for a kitchen sink and is incorporated by reference in its entirety for all purposes. U.S. Pat. No. 9,790,673, issued to Scott et al. and titled "Drain Stopper and Strainer," is another example of a prior art drain stopper and strainer for a kitchen sink and is incorporated by reference in its entirety for all purposes.

For a kitchen sink that has a garbage disposal, one typically sees a rubber splash guard that has prongs or flaps that extend from an outside ring towards a central opening. Food waste washes into or can be pushed into the garbage disposal through the splash guard. The splash guard deteriorates over time and becomes unsightly. Silverware, cutlery and small utensils often fall into the garbage disposal and get damaged when the garbage disposal is turned on. There is a need for kitchen drain stopper and strainer that prevents silverware, cutlery and small utensils from falling into a garbage disposal and that provides an elegant appearance for the interior of a kitchen sink. For a kitchen sink that does not have a garbage disposal, a drain stopper and strainer is typically used, where a strainer basket is typically visible. The strainer basket often has food debris in it, which is unsightly. There is a need for a kitchen drain stopper that has a strainer that prevents food debris and objects from falling into a drain pipe, which provides an elegant appearance for a kitchen sink.

SUMMARY OF THE INVENTION

The present invention provides in one embodiment a drain stopper and strainer for a kitchen sink having a drain opening and a flanged drain fitting attached to the kitchen sink at the drain opening, wherein the flanged drain fitting comprises a tube having an inside wall, a first end having a perimeter, a drain flange that extends radially from perimeter of the first end for retaining the flanged drain fitting in the kitchen sink. The drain stopper and strainer comprises: a cap, a cap seal, an open-close mechanism, a strainer and an annular seal, which comprise a unitary assembly while the drain stopper is assembled to make an assembled drain stopper. The open-close mechanism has upper and lower ends and open and closed positions. The cap is engaged with the upper end of the open-close mechanism, and the cap does not have holes through which water can pass. A cap seal engaged with the cap.

The strainer is engaged with the lower end of the open-close mechanism. The strainer comprises a hollow cylinder having top and bottom ends, where the top end is open. The bottom end has either a first structure for providing small openings or a second structure for providing large openings relative to the small openings. The strainer is designed and sized to allow water to drain from the kitchen sink through the strainer, and the strainer is designed and sized to be sealed against the inside wall of the flanged drain fitting.

The annular seal is engaged with the strainer, preferably proximal to the bottom end of the strainer. The annular seal is designed and sized to seal against the inside wall of the flanged drain fitting, thereby sealing the strainer with the flanged drain fitting for preventing water from draining through an annular space defined between the strainer and the inside wall of the flanged drain fitting.

The cap seal is designed and sized to seal against the top end of the strainer. The cap seal is preferably not designed and sized to seal against the drain flange. The cap and the cap seal are designed and sized to retain water in the kitchen sink while the open-close mechanism is in the closed position and to allow water to drain from the kitchen sink while the open-close mechanism is in the open position.

The assembled drain stopper is designed and sized to fit within the flanged drain fitting. The assembled drain stopper is preferably not designed or sized to cover or rest on the drain flange, and the assembled drain stopper is preferably not designed to be threadedly engaged with the flanged drain fitting. The assembled drain stopper is designed and sized to retain water in the kitchen sink while the open-close mechanism is in its closed position and to allow water to drain from the kitchen sink while the open-close mechanism is in its open position.

The cap is the uppermost component in the assembled drain stopper while in operation, and the cap seal is engaged with a lower portion of the cap. The strainer is the lowermost component in the assembled drain stopper. The strainer has a perimeter along its circumference, and the annular seal is engaged with the perimeter of the strainer. The open-close mechanism extends between the cap and the strainer. The assembled drain stopper is preferably designed so that a user can: (1) push the assembled drain stopper into the flanged drain fitting, (2) operate the open-close mechanism to retain water in or drain water from the kitchen sink without removing the assembled drain stopper from the flanged drain fitting, and (3) can pull the cap and thereby remove the assembled drain stopper from the flanged drain fitting.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

Figure 1:
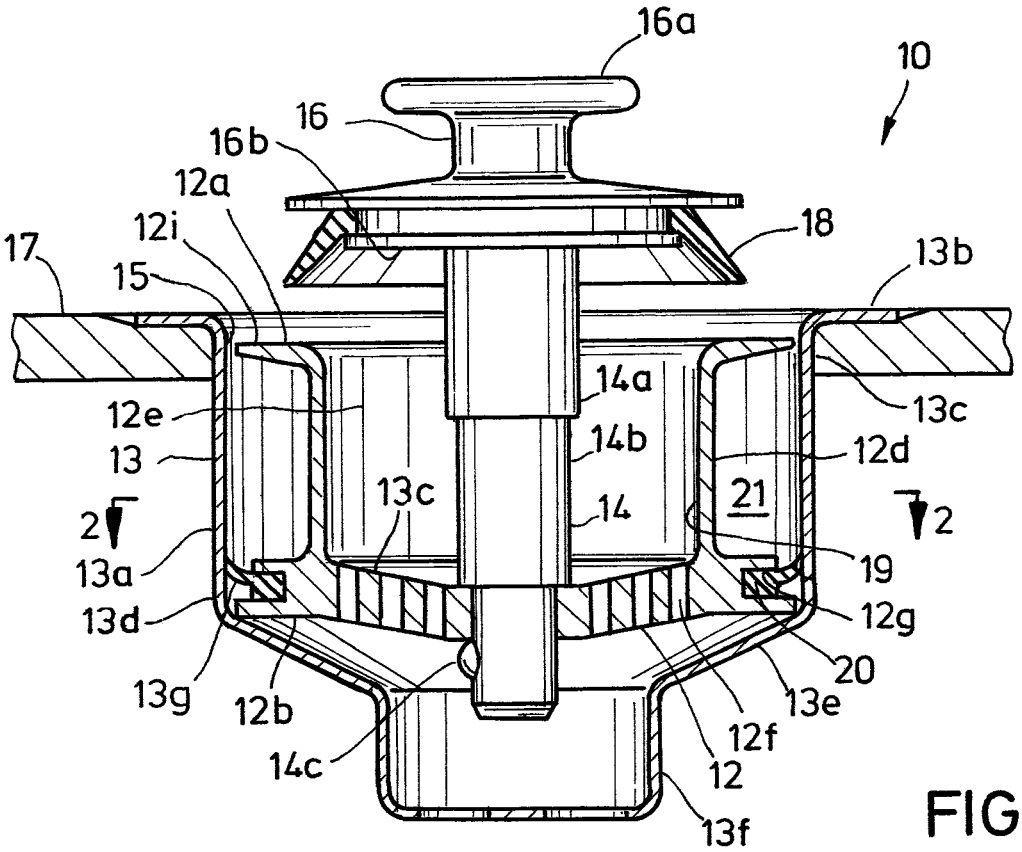
FIG. 1 is a cross-section of a side elevation of a kitchen sink drain stopper and strainer in an open position, according to the present invention.
Figure 2:
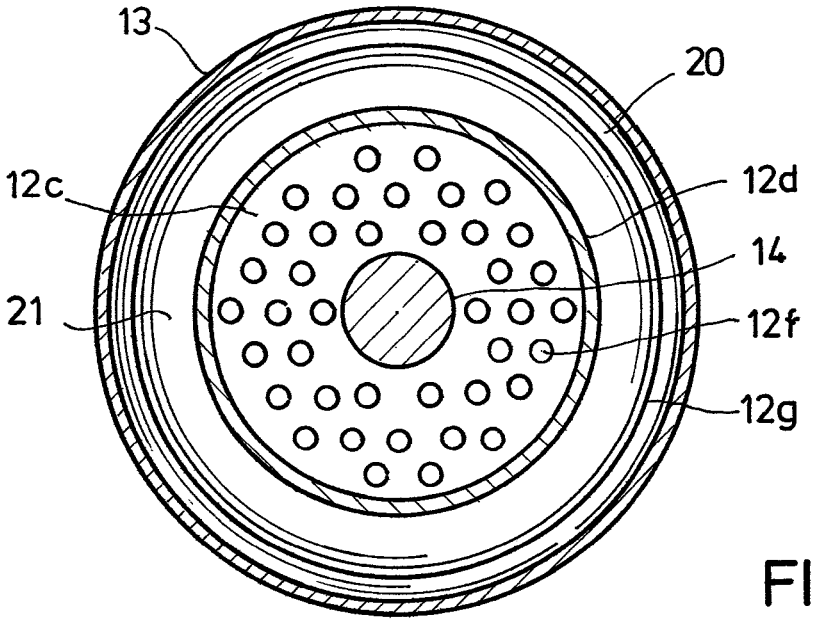
FIG. 2 is a cross-section of the kitchen sink stopper and strainer of FIG. 1 as seen along the line 2-2 in FIG. 1.
Figure 7:
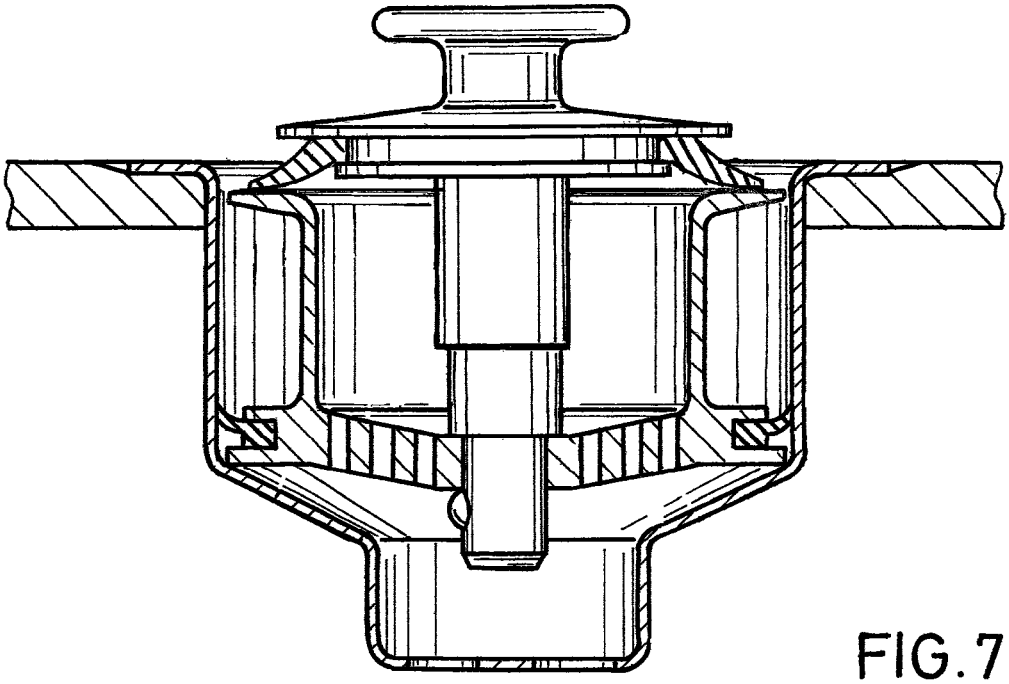
FIG. 7 shows the drain stopper and strainer of FIG. 1 in a closed position.

FIG. 1 is a cross-section of a side elevation of a kitchen sink drain stopper and strainer 10 in an open position, according to the present invention. FIG. 2 is a cross-section of the kitchen sink stopper and strainer 10 of FIG. 1 as seen along the line 2-2 in FIG. 1. FIG. 7 shows the drain stopper and strainer 10 of FIG. 1 in a closed position. A strainer 12 is sized and designed to be received in a flanged drain fitting 13, which seals a drain opening 15 in a kitchen sink 17. A K-7400 kitchen sink drain flange by Kohler Co. is a typical flanged drain fitting. An open-close mechanism 14 has an upper end 14*a* and a lower end 14*b*, which is engaged with the strainer 12. The lower end 14*b* is fitted with a ball-and-spring detent mechanism 14*c*, which comprises a hole, a ball trapped in the hole and a spring received in the hole that pushes the ball outwardly. A cap 16 has an upper end 16*a* and a lower end 16*b*, which is engaged with the upper end 14*a* of the open-close mechanism 14. The lower end 16*b* preferably comprises a tube that has a bore defined by interior threads. A cap seal 18 is engaged with the cap 16 and provides a seal between the cap and the strainer 12. The tube preferably depends from the upper end 16*a* and has a circumferential groove. Cap seal 18 is preferably frustoconical in shape and has a small end that fits in the circumferential groove. A different type of sealing system can be used, such as an O-ring seal.

Strainer 12 has an upper end 12*a* and an opposing lower end 12*b*. A perforated bottom plate 12*c* is located at or near the lower end 12*b*. A sidewall 12*d* extends between the lower end 12*b* and the upper end 12*a*. Sidewall 12*d* has an inside surface 19 that along with the perforated bottom plate 12*c* defines a volume or space 12*e*. Sidewall 12*d* may or may not be perforated. The bottom plate 12*c* and the sidewall 12*d* may have various types of openings 12*f* typically used for a strainer basket. One function of strainer 12 is as a strainer basket.

An annular seal 20 is received on and attached to or formed integral with the strainer 12 and is shown located near the lower end 12*b* of the strainer 12. Annular seal 20 can be located near the upper end 12*a* of the strainer 12. Strainer 12 preferably has a circumferential groove 12*g* in which the Annular Seal 20 is Received. The Purpose and Function of Annular Seal 20 is to seal the strainer 12 with the flanged drain fitting 13 so that water draining from a kitchen sink will flow into the volume or space 12*e* of the strainer 12 rather than through an annular space defined between an outer surface of the strainer 12 and an inner surface of the flanged drain fitting 13. The strainer 12 can be referred to as a strainer basket in one embodiment. Annular seal 20 provides a gasket or a sealing means between the strainer 12 and the flanged drain fitting 13. The embodiment of the annular seal 20 shown in the FIG. 1 has the shape of a washer, an annulus, a ring-shaped flat plate having inner and outer edges and upper and lower planar surfaces. The outer edge of annular seal 20 is its perimeter. The annular seal 20 has a diameter from one edge of its perimeter through a center point to an opposing edge of the perimeter. The upper end 12*a* of the strainer 12 also has a diameter, which is preferably less than the diameter of the annular seal 20.

The flanged drain fitting 13 in FIG. 1 comprises a large-diameter cylindrical tube 13*a* having a radially-extending flange 13*b* on an upper end 13*c* and an opposing end 13*d*. The flanged drain fitting 13 has a conical portion 13*e* below the end 13*d* of the tube 13*a*. The conical portion 13*e* has an upper end that has a same diameter as the tube 13*a*. A small-diameter cylindrical tube 13*f*, which has a lesser diameter than the diameter of tube 13*a*, is received at a lower end of the conical portion 13*e*. The flanged drain fitting 13 has a reduced-diameter transition 13*g* where the large-diameter cylindrical tube 13*a* transitions into the conical portion 13*e*. The lower end 12*b* of the strainer 12 rests on the transition 13*g*. The kitchen sink stopper and strainer 10 is not fastened to the flanged drain fitting 13. The kitchen sink stopper and strainer 10 is not threadedly engaged with the flanged drain fitting 13. A user can push the kitchen sink stopper and strainer 10 into the flanged drain fitting 13 until the lower end 12*b* of the strainer 12 rests on the transition 13*g*, without any assembly with the fitting 13, and the user can pull the kitchen sink stopper and strainer 10 out of the flanged drain fitting 13, without any disassembly from the fitting 13.

Kitchen sink stopper and strainer 10 uses a dual-seal system. Stopper/strainer 10 rests on the transition 13*g* in the flanged drain fitting 13. An annular space 21 is defined between an outside surface of the strainer 12 and an inside surface of the flanged drain fitting 13. Annular seal 20 seals the strainer 12 inside the large-diameter cylindrical tube 13*a* in the flanged drain fitting 13. Annular seal 20 provides a seal between the outside surface of the strainer 12 and an inside surface of the flanged drain fitting 13, thereby blocking the flow of water through the annular space 21 and forcing water to drain through the strainer 12. While the open-close mechanism 14 is in the open position, water can drain from the kitchen sink through the strainer 12, particularly through the perforated bottom plate 12*c*, which strains out food waste and objects that are too large to pass through the openings 12*f*. When the open-close mechanism is moved into its closed position, the lower end of the cap seal 18 presses against the upper end 12*a* of the strainer 12. The upper end 12*a* of the strainer 12 is preferably a rim that has a smooth upper surface for sealingly receiving the lower end of the cap seal 18. Prior art kitchen drain stoppers seal against a drain pipe that corresponds to the flanged drain fitting shown in FIG. 1. Prior art kitchen drain stoppers typically rely on one seal, which is often a conical seal that provides a seal with a drain portion that corresponds to the small-diameter cylindrical tube 13*f* in the flanged drain fitting 13 shown in FIG. 1. Stopper/strainer 10 does not seal against or within the small-diameter cylindrical tube 13*f* in the flanged drain fitting 13 shown in FIG. 1. Stopper/strainer 10 uses: (1) the annular seal 20 to seal the strainer 12 within the large-diameter cylindrical tube 13*a* in the flanged drain fitting 13 and (2) the cap seal 18 to seal against the upper end 12*a* of the strainer 12 for retaining water in the kitchen sink. Stopper/strainer 10 works best with two seals, namely the cap seal 18 and the annular seal 20. The cap seal 18, which is used to retain water in a kitchen sink, preferably does not seal against the flanged drain fitting 13, although the lower end of the cap seal 18 may press on the upper end 12*a* of the strainer 12 and slide radially to press against an inside surface of the flanged drain fitting 13. An alternative embodiment has the cap seal 18 sealing against an upper surface of the radially-extending flange 13*b* on the upper end 13*c* of the large-diameter cylindrical tube 13*a* in the flanged drain fitting 13.

Prior art kitchen drain stoppers and strainers often place a strainer basket such that it remains visible and unsightly in the bottom of a kitchen sink. Stopper/strainer 10 of the present invention places cap 16 in an uppermost position. Cap 16 is visible in the bottom of a kitchen sink, and the strainer 12 tends to be hidden from sight. Unlike many prior art kitchen drain stoppers and strainers, strainer 12 is not above the cap seal 18 that is used to retain water in the kitchen sink. Cap 16 can be decorative and ornamental to provide an elegant appearance in the bottom of a kitchen sink. Stopper/strainer 10 of the present invention is also very functional while also having an elegant appearance. The drain stopper and strainer 10 comprises cap 16, cap seal 18, open-close mechanism 14, strainer 12 and annular seal 20, which together comprise a unitary assembly while the stopper/strainer 10 is assembled. The assembled drain stopper and strainer 10 has a longitudinal axis that passes through the length of the open-close mechanism 14, and the cap 16, cap seal 18, open-close mechanism 14, strainer 12 and annular seal 20 are radially symmetrical about the longitudinal axis while assembled. A user can assemble or can purchase a pre-assembled stopper/strainer 10 and thereby have a drain stopper and strainer that is a unitary assembly. A user can push the stopper/strainer 10 into the flanged drain fitting 13 as a unitary assembly. The user can retain water in the kitchen sink after placing the open-close mechanism 14 in its closed position. The user can drain water from the sink by operating to the open-close mechanism 14, preferably by a push on the cap 16, to place the open-close mechanism 14 in its open position. For cleaning the strainer 12, the user can pull the stopper/strainer 10 out of the flanged drain fitting 13, preferably as a unitary assembly, depending on how tightly the ball-and-spring mechanism 14*c* is engaged with the strainer 12 versus how tightly the strainer 12 is engaged with the flanged drain fitting 13. If the stopper/strainer 10 pulls out as a unitary assembly, then the user can then hold the strainer 12 and pull the cap 16 to pull the open close mechanism 14 out of the strainer 12, since the ball-and-spring detent mechanism 14*c* allows this disengagement. The user can clean the strainer 12; reinsert the open-close mechanism 14 in the strainer 12; and reinsert the stopper/strainer 10 into the flanged drain fitting 13.

Another type of prior art kitchen drain stopper and strainer has a strainer basket that has a radially-extending peripheral flange at an upper end that rests on the bottom of a sink within a drain opening. With reference to FIG. 1, the peripheral flange for the prior art drain stopper would rest on the radially-extending flange 13*b* on the upper end of the flanged drain fitting 13. Stopper/strainer 10 of the present invention does not rest on a sink bottom and does not rest a radially-extending flange on an upper end of a flanged drain fitting that is received in a drain opening in a sink. Strainer 12 of the present invention resides entirely within the flanged drain fitting 13 while in operation. This type of prior art kitchen drain stopper and strainer is believed to have a connection between its open-close mechanism and its strainer that cannot be easily disconnected and reconnected for making it easy to clean the strainer. Stopper/strainer 10 of the present invention has an easy connect and easy disconnect method for attaching the open-close mechanism 14 to the strainer 12 with the ball-and-spring detent mechanism 14*c*. Stopper/strainer 10 can be easily pushed into and pulled out of the flanged drain fitting 13 as a unitary assembly, and the strainer 12 can be easily disconnected from the open-close mechanism 14 for cleaning the strainer 12. The strainer 12 can be easily reconnected to the open-close mechanism, and the stopper/strainer 10 can be easily pushed back into the flanged drain fitting 13. Stopper/strainer 10 of the present invention has an easy-connect mechanism for attaching the open-close mechanism 14 to the strainer 12. The ball-and-spring detent mechanism 14*c* is one example of the easy-connect mechanism Another example is a single-turn engagement such as a quarter-turn, wherein the lower end of the open close mechanism 14 is placed in the central opening in the hub in the bottom of the strainer 12 and turned about 90 degrees to engage the open-close mechanism 14 with the strainer 12. As another example of an easy-connect mechanism, the lower end of the open-close mechanism could have a ball, and the strainer could have a socket, where the ball can be pressed through and pulled out of the socket with moderate force by a user. U.S. Pat. No. 4,232,407, issued to Williams, discloses prongs that can be squeezed together to pass through the central opening in the hub in the bottom of the strainer 12, where the prongs spring outwardly after passing through the opening, which is another easy-connect mechanism. A threaded connection that requires multiple turns for full engagement is not considered an easy-connect mechanism. An easy-connect mechanism is a connection between the open-close mechanism 14 and the strainer 12 that allows the strainer to be easily removed from the open-close mechanism for cleaning the strainer, where the strainer can be easily reconnected to the open-close mechanism, where multiple turns for a threaded connection is not required, where no tool is required, and where a person can use her hands to disconnect the strainer from the open-close mechanism and to reconnect the strainer to the open-close mechanism without use of a tool.

Drain stoppers often have open-close mechanisms referred to as a push-push or push-type, a lift and lock or a lift and turn mechanism. Related U.S. patent application Ser. No. 15/584,032 filed May 2, 2017 discloses a push-type open-close mechanism. U.S. Patent Application Pub. No. 2011/0138527 A1 by Siena et al. discloses a drain stopper with a lift and lock mechanism, which is incorporated by reference. U.S. Patent Application Pub. No. 2013/0125299 A1 by Tong discloses a drain stopper with a lift and turn mechanism, which is incorporated by reference. The open-close mechanism 14 is preferably a push-type mechanism in which a first push downward on the cap moves the stopper from the open position to the closed position and a subsequent push downward on the cap moves the stopper from the closed position back to the open position.

Figure 3:
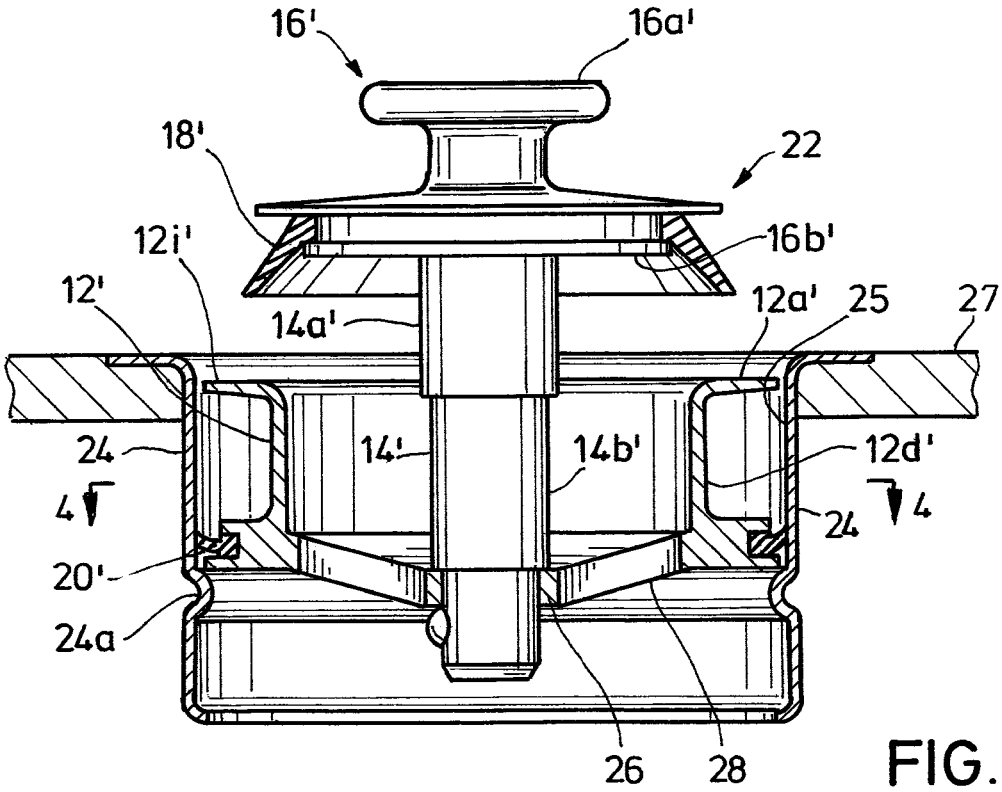
FIG. 3 is a cross-section of a side elevation of a kitchen sink drain stopper and strainer in an open position, according to the present invention.
Figure 4:
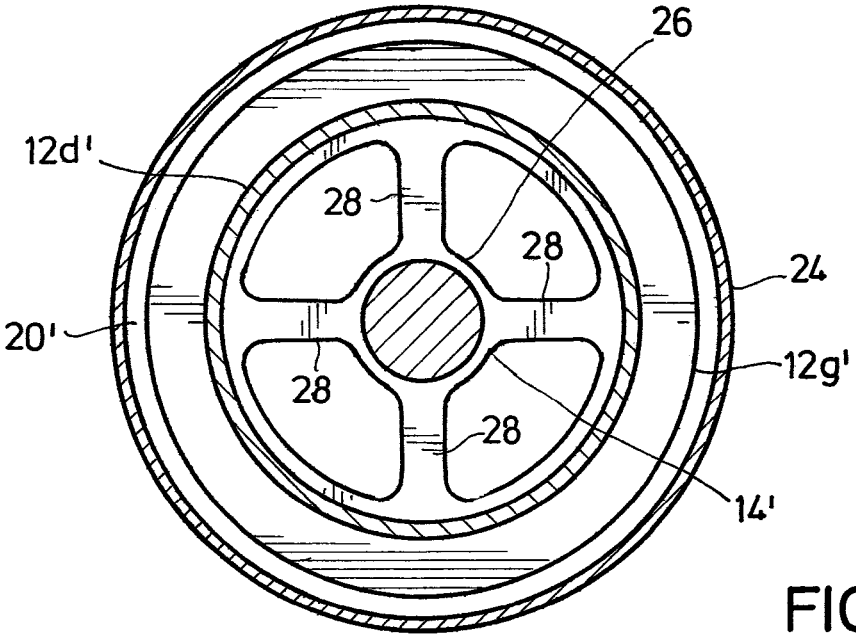
FIG. 4 is a cross-section of the kitchen sink stopper and strainer of FIG. 3 as seen along the line 4-4 in FIG. 3.
Figure 8:
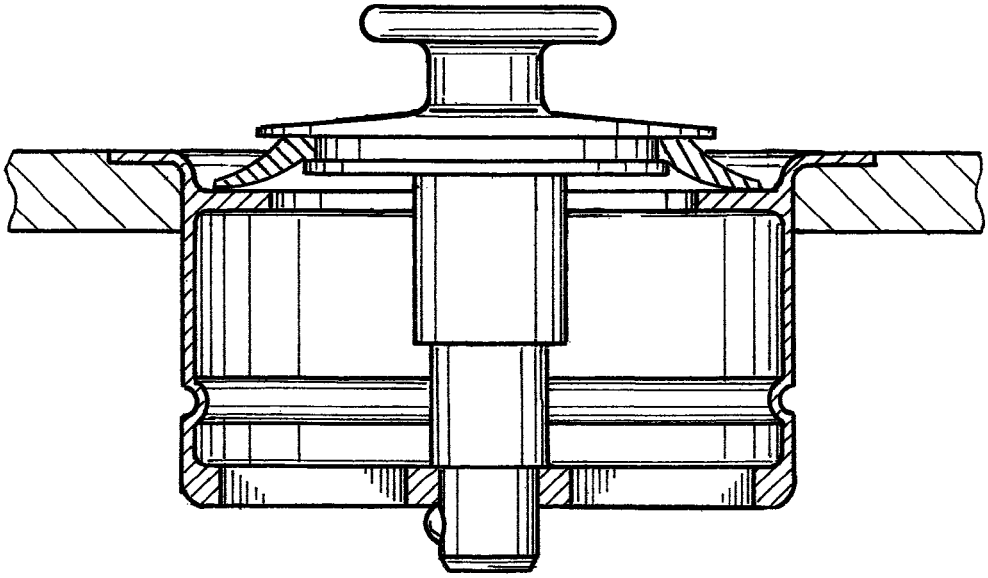
FIG. 8 shows the drain stopper and strainer of FIG. 3 in a closed position.

FIG. 3 is a cross-section of a side elevation of a kitchen sink drain stopper and strainer 22 in an open position, according to the present invention. FIG. 4 is a cross-section of the kitchen sink stopper and strainer 22 of FIG. 3 as seen along the line 4-4 in FIG. 3. FIG. 8 shows the drain stopper and strainer 22 of FIG. 3 in a closed position. The kitchen sink stopper and strainer 22 is received in a disposal flange 24, which seals a drain opening 25 in a kitchen sink 27. An InSinkErator® brand sink flange for receiving an InSinkErator® brand garbage disposal unit is a typical disposal flange. The flanged drain fitting 13 in FIG. 1 is typically used in a kitchen sink drain assembly that does not include a garbage disposal unit. Disposal flange 24 in FIG. 3 is typically used in a kitchen sink drain assembly that includes a garbage disposal unit. Stopper/strainer 22 is very similar to kitchen sink stopper and strainer 10, and like elements are given the same numbers except having a prime mark after the number. Stopper/strainer 22 has an open-close mechanism 14' that has an upper end 14*a*' and a lower end 14*b*', which is engaged with a strainer element 12'. A cap 16' has an upper end 16*a*' and a lower end 16*b*', which is engaged with the upper end 14*a*' of the open-close mechanism 14'. A cap seal 18' is engaged with the cap 16' and provides a seal between the cap 16' and the strainer element 12'. Strainer elements 12 and 12' have a rim 12*i* and 12*i*' on their upper end 12*a* and 12*a*', which provides a smooth, horizontal surface while in operation for receiving the cap seal 18 or 18' in a sealing engagement for preventing water from flowing from a sink through the strainer 12 or 12'. Stopper/strainer 22 differs from the kitchen sink stopper and strainer 10 in that, instead of a perforated bottom plate and strainer basket, stopper/strainer 22 has a centralized hub 26 and spokes 28 that radiate from the hub 26 to an inside surface of the sidewall 12*d*' of the strainer element 12'. An annular seal 20' is received on and attached to or formed integral with the strainer element 12'.

The disposal flange 24 is received in the drain opening 25 in the kitchen sink 27, and an upper end would be fastened to and sealed with a bottom portion of the kitchen sink 27. A lower end of the disposal flange 24 would be connected to a garbage disposal unit, which is not shown. The disposal flange 24 has a circumferential groove 24*a*, which is used in connecting a garbage disposal unit to the disposal flange 24. The garbage disposal unit would discharge into a drain pipe, thereby providing a passageway for water to drain from the kitchen sink to a sewer system. The stopper/strainer 22 can be placed into the disposal flange 24 by pressing the stopper/strainer 22 down into the disposal flange 24 until the lower end of the strainer 12' rests on the inside shoulder formed by the circumferential indentation 24*a*. The annular seal 20' engages and seals against an inside wall of the disposal flange 24. The centralized hub 26 can have a threaded opening for receiving the lower end 14*b*' of the open-close mechanism 14'. The lower end 14*b*' is preferably fitted with a ball-and-spring detent mechanism 14*c*' for engaging the open-close mechanism 14' with the strainer 12'. The strainer 12' preferably has four spokes 28 that divide the flow passageway into quadrants. The spokes 28 provide enough open space for water and food waste to flow into the garbage disposal while the stopper/strainer 22 is in an open position, but the spokes 28 in combination with the cap 16' tend to prevent spoons, forks, knives, cutlery, larger portions of food waste and larger objects from falling into the garbage disposal. A user would press stopper/strainer 22 into disposal flange 24 until the lower end 12*b*' of the strainer element 12' rests on the inside shoulder formed by the indentation 24*a*. The cap seal 18' contacts and forms a watertight seal with the upper surface 12*i*' of the strainer element 12' while the open-close mechanism is in its closed position.

Figure 5:
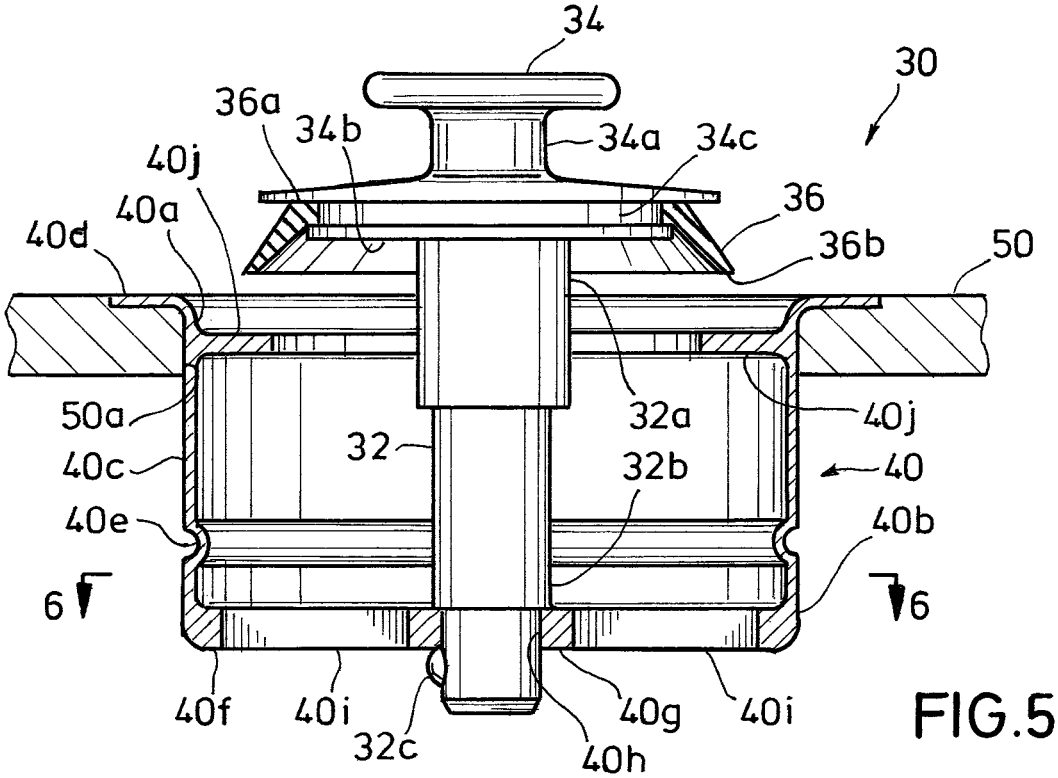
FIG. 5 is a side elevation in cross-section of a drain stopper in a disposal flange, according to the present invention.
Figure 6:
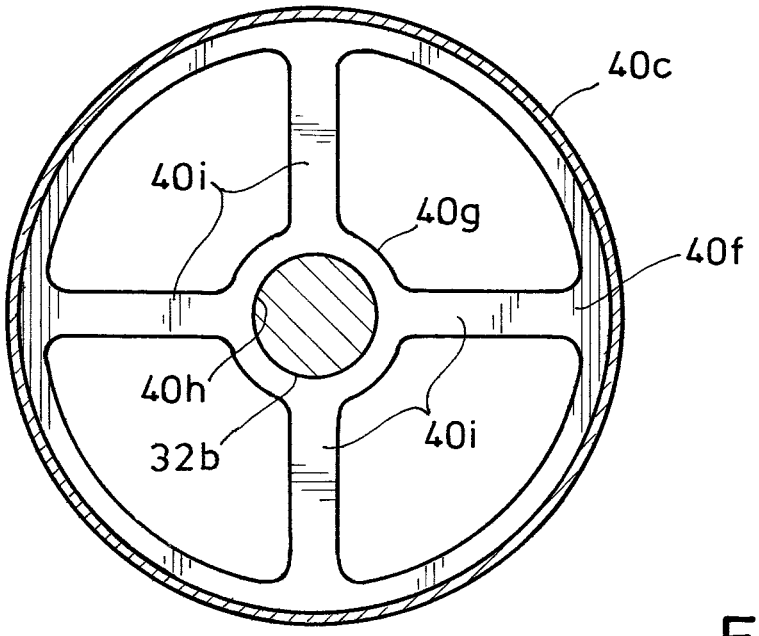
FIG. 6 is a cross-section of the drain stopper and disposal flange of FIG. 5 as seen along the line 6-6 in FIG. 5.

FIG. 5 is a side elevation in cross-section of a drain stopper 30 in a disposal flange 40, according to the present invention. FIG. 6 is a cross-section of the drain stopper 30 and disposal flange 40 as seen along the line 6-6 in FIG. 5. The disposal flange 40 is received in a kitchen sink 50 and passed through a drain opening 50*a* in the kitchen sink 50. The disposal flange 40 has an upper end 40*a*, a lower end 40*b*, a side wall 40*c*, a radially-outwardly-extending flange 40*d* on the upper end 40*a*, and a circumferential groove or indentation 40*e* near the lower end 40*b*. The disposal flange 40 is designed and sized to receive a garbage disposal unit, which is not shown. Groove 40*e* provides a portion of a connection mechanism used to connect the garbage disposal unit to the disposal flange 40.

A hub-and-spoke structure 40*f*, which is best seen in FIG. 6, is attached to or formed integral with the side wall 40*c* at the lower end 40*b* of the disposal flange 40. The hub-and-spoke structure 40*f* has a central hub 40*g*, which has a central opening 40*h*, and a plurality of spokes 40*i*, which extend between the hub 40*g* and an inside surface of the side wall 40*c*. The hub-and-spoke structure 40*f* is shown as having four spokes 40*i*, but a different number of spokes can be used. The spokes 40*i* tend to prevent silverware, cutlery and small utensils from falling into the garbage disposal unit, particularly in combination with the drain stopper 30.

The drain stopper 30 comprises an open-close mechanism 32, a cap 34 and a cap seal 36. The open-close mechanism 32 has an upper end 32*a* and a lower end 32*b*. The lower end 32*b* is fitted with a ball-and-spring detent mechanism 32*c*, which comprises a hole, a ball trapped in the hole and a spring received in the hole that pushes the ball radially outwardly. The lower end 32*b* of the open-close mechanism 32 is received in the central opening 40*h* of the hub 40*g* in the hub-and-spoke structure 40*f* in the disposal flange 40. The ball-and-spring detent mechanism 32*c* passes through the central opening 40*h*, after which, the ball is pushed radially outwardly, thereby engaging the lower end 32*b* of the open-close mechanism 32 with the disposal flange 40. The ball-and-spring detent mechanism 32*c* can be part of a separate rod that is attached to the lower end 32*b* of the open-close mechanism 32. The cap 34 has an upper end 34*a* and a lower end 34*b*, which is engaged with the upper end 32*a* of the open-close mechanism 32. The lower end 34*b* of the cap preferably comprises a tube that has a bore defined by interior threads. The tube preferably has a circumferential groove 34*c*. The upper end of the cap 34 can be dome shaped or can have the grip shown in FIG. 5. A cap seal 36 is engaged with the cap 34. The cap seal 36 preferably has a frustoconical shape, meaning it has a cone shape, except the pointed end of the cone has been cut off perpendicular to the longitudinal axis of the cone. The cap seal 36 has an upper small diameter end 36*a* and a lower relatively larger diameter end 36*b*. The upper end 36*a* of the cap seal 36 is received in the circumferential groove 34*c* of the cap 34.

The cap seal 36 can be designed and sized to seal against the flange 40*d* on the upper end 40*a* of the disposal flange 40 or against an inside wall of the side wall 40*c* of the disposal flange 40. FIG. 5 shows an inside shoulder 40*j* that projects radially inwardly from the inside wall of the side wall 40*c* of the disposal flange 40. Inside shoulder 40*j* has a smooth upper surface for sealingly receiving the lower end 36*b* of the cap seal 36. The drain stopper 16' of FIG. 3 can be used as the drain stopper 30 in FIG. 5, provided the strainer element 12' is removed from the open-close mechanism 14'. This allows an interchangeability between components of the drain stoppers and strainers of the present invention. A kit can be made and sold that includes the drain stopper 30 and the disposal flange 40 of FIG. 5.

EMBODIMENTS OF THE INVENTION

The present invention includes the following embodiments.

A drain stopper and strainer for a kitchen sink having a drain opening and a flanged drain fitting attached to the kitchen sink at the drain opening, the drain stopper and strainer comprising: an open-close mechanism having upper and lower ends; a cap engaged with the upper end of the open-close mechanism; a cap seal engaged with the cap; a strainer engaged with the lower end of the open-close mechanism, wherein the strainer is designed and sized to be sealed with the flanged drain fitting; and an annular seal engaged with the strainer, wherein the cap seal is designed and sized to seal against the strainer, and wherein the annular seal is designed and sized to seal against the flanged drain fitting, thereby sealing the strainer with the flanged drain fitting. The open-close mechanism is preferably a push-type mechanism.

A drain stopper and strainer for a kitchen sink having a drain opening and a flanged drain fitting attached to the kitchen sink at the drain opening, wherein the flanged drain fitting comprises a tube having an inside wall, a first end having a perimeter, a drain flange that extends radially from perimeter of the first end for retaining the flanged drain fitting in the kitchen sink. The drain stopper and strainer comprises: a cap, a cap seal, an open-close mechanism, a strainer and an annular seal, which comprise a unitary assembly while the drain stopper is assembled to make an assembled drain stopper. The open-close mechanism has upper and lower ends and open and closed positions. The open-close mechanism can be a lift-and-lock, a lift-and-turn or a push-type mechanism and is preferably a push-type mechanism. The cap is engaged with the upper end of the open-close mechanism, and the cap does not have holes through which water can pass. A cap seal is engaged with the cap.

The strainer is engaged with the lower end of the open-close mechanism. The strainer comprises a hollow cylinder having top and bottom ends, where the top end is open. The bottom end has either a first structure for providing small openings or a second structure for providing large openings relative to the small openings. The strainer is designed and sized to allow water to drain from the kitchen sink through the strainer, and the strainer is designed and sized to be sealed against the inside wall of the flanged drain fitting.

The annular seal is engaged with the strainer, preferably near the bottom end of the strainer. The annular seal is designed and sized to seal against the inside wall of the flanged drain fitting, thereby sealing the strainer with the flanged drain fitting for preventing water from draining through an annular space defined between the strainer and the inside wall of the flanged drain fitting.

The cap seal is designed and sized to seal against the top end of the strainer. The cap seal is preferably not designed and sized to seal against the drain flange. The flanged drain fitting has an inside diameter, and the cap seal preferably has a diameter that is approximately the same as, but slightly less than the inside diameter of the flanged drain fitting. The cap also preferably has a diameter that is slightly less than the inside diameter of the flanged drain fitting, although the cap can be sized to cover and hide the drain flange on the flanged drain fitting that is visible in the bottom of a sink. The cap and the cap seal are designed and sized to retain water in the kitchen sink while the open-close mechanism is in the closed position and to allow water to drain from the kitchen sink while the open-close mechanism is in the open position. The cap and the cap seal can be designed and sized to cover and hide the flanged drain fitting.

The assembled drain stopper is designed and sized to fit within the flanged drain fitting. The assembled drain stopper is preferably not designed or sized to cover or rest on the drain flange, and the assembled drain stopper is preferably not designed to be threadedly engaged with the flanged drain fitting. The assembled drain stopper is designed and sized to retain water in the kitchen sink while the open-close mechanism is in its closed position and to allow water to drain from the kitchen sink while the open-close mechanism is in its open position.

The cap is the uppermost component in the assembled drain stopper while in operation, and the cap seal is engaged with a lower portion of the cap. The strainer is the lowermost component in the assembled drain stopper. The strainer has a perimeter along its circumference, and the annular seal is engaged with the perimeter of the strainer. The open-close mechanism extends between the cap and the strainer. The assembled drain stopper is preferably designed so that a user can: (1) push the assembled drain stopper into the flanged drain fitting, (2) operate the open-close mechanism to retain water in or drain water from the kitchen sink without removing the assembled drain stopper from the flanged drain fitting, and (3) can pull the cap and thereby remove the assembled drain stopper from the flanged drain fitting. The assembled drain stopper is preferably not attached to the flanged drain fitting, such as by a threaded engagement of the open-close mechanism with a hub in the flanged drain fitting, so no disassembly is required before pulling the assembled drain stopper out of the flanged drain fitting.

The drain stopper and strainer is preferably further described as follows. The first structure in the strainer comprises a perforated plate having a central opening for receiving the open-close mechanism. The second structure in the strainer comprises a central hub and a plurality of spokes that extend between the central hub and an inside surface in the strainer. The first and second structures in the strainer have a central opening for receiving the lower end of the open-close mechanism Although not a preferred embodiment, the open-close mechanism can be threadedly engaged with the strainer. Preferably, the open-close mechanism is engaged with or held in the strainer by a ball-and-spring detent mechanism. The detent mechanism allows a user to easily pull the strainer off of the open-close mechanism so that food debris can be more easily cleaned out of the strainer basket.

Preferably, the strainer has an inside wall, and the first and second structures comprise a central hub and a plurality of spokes that extend between the inside wall and the central hub. The first structure comprises a perforated or screen structure extending between or attached to the plurality of spokes so that the strainer functions as a strainer basket. The second structure is open between the spokes and does not have a perforated or screen structure extending between or attached to the plurality of spokes so that a strainer with the second structure does not function as a strainer basket. The purpose of the second structure is to prevent silverware, cutlery and small utensils from falling into a garbage disposal located below the second structure.

The central hub in the first and second structures have a central opening, which may or may not be threaded. The open-close mechanism preferably has a ball-and-spring detent mechanism attached to or formed in its lower end. The ball-and-spring detent mechanism passes through the central opening while the ball is pressed into the opening in the detent mechanism, which compresses the spring. After the ball passes through the central opening, the spring pushes the ball out, and the open-close mechanism becomes detachably attached to the central hub in the first or second structure. The ball is below the bottom end of the strainer while the assembled drain stopper is in operation. The ball-and-spring detent mechanism is designed and sized to detachably attach the assembled drain stopper to the first or second structure in the strainer so that a user can pull the strainer off of the open-close mechanism and then put the strainer back on the open-close mechanism easily. This is particularly useful for a non-disposal drain, where the strainer functions as a strainer basket so that the user can clean the strainer. That functionality is not particularly needed for a drain into a garbage disposal, where the second structure is used, so the open-close mechanism can be threadedly engaged with the second structure. In any case, the lower end of the open-close mechanism can have exterior threads for a threaded engagement with interior threads in the opening in the central hub in the first and second structures in the strainer, although a ball-and-spring detent mechanism in the lower end of the open-close mechanism may be a preferred means of engagement.

The cap can have a variety of different shapes, including a dome-shaped uppermost portion or a smaller grip portion at an uppermost end. The cap preferably has a hollow tube protruding downwardly from the uppermost portion or end, where preferably, interior threads define a longitudinal bore in the hollow tube. The hollow tube preferably has a groove or a recess around its circumference. The cap seal preferably has a hollow frustoconical shape with a smaller diameter upper end relative to a larger diameter lower end. The smaller diameter upper end of the cap seal is preferably received in the groove in the circumference of the hollow tube that depends downwardly from the upper portion of the cap, thereby engaging the cap seal with the cap. The larger diameter lower end of the cap seal is preferably sized to seal against the top end of the strainer, particularly for a stopper/strainer for a non-disposal flanged drain fitting.

The upper end of the open-close mechanism preferably has exterior threads and is preferably threadedly engaged with the cap. Other types of connections can be used, such as press fit, adhesion and integral formation. The hollow-tube portion of the cap preferably has a sufficient length for receiving the open-close mechanism to different depths, thereby providing an adjustable length between the uppermost portion of the cap and the lower end of the open-close mechanism. Another option is to include a lock nut on the exterior threads on the upper end of the open-close mechanism, where the lock nut can be tightened against the hollow tube of the cap for holding a constant length between the uppermost portion of the cap and the lower end of the open-close mechanism.

Another aspect of the present invention includes a new disposal flange. A prior art disposal flange includes a hollow tube having an inside diameter that is greater than its length, where the hollow tube has upper and lower ends while installed in a kitchen sink. The upper end has a flange that extends radially from the circumference of the tube, which is visible in the bottom of a sink after installation. Near the lower end of prior art disposal flange is an indentation around the circumference of the hollow tube, which is used in connecting a garbage disposal unit to the disposal flange. A garbage disposal unit having the brand name Insinkerator® is often installed with a prior art disposal flange that bears the Insinkerator® brand name. Prior art disposal flanges are completely hollow with a longitudinal flow path defined by an inside wall of the hollow tube and the indentation proximal to the lower end.

The disposal flange of the present invention includes the elements of the prior art disposal flange plus a hub-and-spokes structure in the lower end of the hollow tube below the indentation. The disposal flange of the present invention includes a hollow tube having an inside diameter that is greater than its length, where the hollow tube has upper and lower ends while installed in a kitchen sink. The upper end has a flange that extends radially from the circumference of the tube, which is visible in the bottom of a sink after installation. Near the lower end of prior art disposal flange is an indentation around the circumference of the hollow tube, which is used in connecting a garbage disposal unit to the disposal flange. A hub-and-spokes structure is received in the lower end of the hollow tube below the indentation. The hub in the hub-and-spokes structure has a central opening that is coaxial with the longitudinal axis of the hollow tube. A plurality of spokes extend between the hub and the inside wall of the tube. The hub-and-spokes structure in the disposal flange of the present invention resembles closely the second structure in the strainer in the drain stopper and strainer of the present invention and serves the same purpose of tending to prevent silverware, cutlery and small kitchen utensils from falling into the garbage disposal unit.

The disposal flange of the present invention has an inside shoulder attached to or formed integral with the inside wall of the hollow tube between the upper end of the tube and the indentation. The inside shoulder resembles the top end of the strainer in the drain stopper and strainer of the present invention. A drain stopper according to the present invention for the disposal flange of the present invention comprises the drain stopper described above, except without the strainer. The strainer functionality is replaced by the hub-and-spokes structure in the inventive disposal flange. A drain stopper according to the present invention for the disposal flange of the present invention comprises an open-close mechanism having upper and lower ends, a longitudinal axis and open and closed positions; a cap engaged with the upper end of the open-close mechanism, wherein the cap does not have holes through which water can pass; and a cap seal engaged with the cap, without the strainer described above. The lower end of the open-close mechanism and the hub-and-spokes structure in the disposal flange of the present invention are each designed and sized for the lower end of the open-close mechanism to be received in the central opening in the hub-and-spokes structure in the disposal flange. The plurality of spokes in the hub-and-spokes structure in the disposal flange tend to prevent silverware, cutlery and small kitchen utensils from falling into a garbage disposal unit connected to the new disposal flange.

With the disposal flange of the present invention, a kit can be provided that comprises a drain stopper and a disposal flange for receiving a garbage disposal unit below a kitchen sink. The disposal flange comprises a hollow cylinder having opposing first and second ends, a flange extending radially from the first end for resting in the kitchen sink while the cylinder extends through a drain opening in the kitchen sink and a hub-and-spoke structure in the second end of the cylinder. The drain stopper comprises: an open-close mechanism having upper and lower ends and open and closed positions; a cap engaged with the upper end of the open-close mechanism, wherein the cap does not have holes through which water can pass; and a cap seal engaged with the cap, wherein the cap and the cap seal are designed and sized to retain water in the kitchen sink while the open-close mechanism is in its closed position, and wherein the lower end of the open-close mechanism is adapted to be received in the hub of the hub-and-spoke structure in the disposal flange. The open-close mechanism is preferably a push-type mechanism.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain stopper and strainer for a kitchen sink having a drain opening and a flanged drain fitting attached to the kitchen sink at the drain opening, wherein the flanged drain fitting comprises a tube having an upper end, a radial-extending flange on its upper end and an inside shoulder spaced away from the upper end, wherein the radially-extending flange has an upper surface, and wherein the upper surface is at or below a lowermost inside surface of the kitchen sink while in operation, the drain stopper and strainer comprising:

an open-close mechanism having upper and lower ends and open and closed positions;

a cap engaged with the upper end of the open-close mechanism;

a cap seal engaged with the cap;

a strainer element engaged with the lower end of the open-close mechanism, wherein the strainer element has a sealing surface, wherein the cap seal seals against the sealing surface of the strainer element, wherein the sealing surface of the strainer element is at or below the upper surface of the radially-extending flange while in operation, and wherein the strainer element is designed and sized to be sealed with the flanged drain fitting; and an annular seal engaged with the strainer element, wherein the annular seal is designed and sized to prevent water from flowing through an annular space defined between the strainer element and the flanged drain fitting, and wherein the drain stopper and strainer is designed, sized and configured to be removably received in the flanged drain fitting and to rest on the inside shoulder of the flanged drain fitting.

2. The drain stopper and strainer of claim 1, wherein the strainer element of the drain stopper and strainer is designed, configured and sized to rest entirely within the flanged drain fitting, wherein the drain stopper and strainer is not designed to be attached to the flanged drain fitting, and wherein the drain stopper and strainer is designed to be pushed into and pulled out of the flanged drain fitting without connecting to or disconnecting from the flanged drain fitting.

3. The drain stopper and strainer of claim 1, wherein the strainer element comprises a hollow cylinder having top and bottom ends, wherein the top end has the sealing surface for receiving the cap seal while the open-close mechanism is in its closed position, wherein the bottom end comprises a central hub having an opening for receiving the lower end of the open-close mechanism, and wherein the bottom end comprises a perforated plate so that the strainer element functions as a strainer basket.

4. The drain stopper and strainer of claim 1, wherein the strainer element comprises a hollow cylinder having an inside wall and top and bottom ends, wherein the top end has the sealing surface for receiving the cap seal while the open-close mechanism is in its closed position, wherein the bottom end comprises a central hub having an opening for receiving the lower end of the open-close mechanism, wherein the bottom end comprises a plurality of spokes that extend between the central hub and the inside wall of the hollow cylinder, and wherein the bottom end is open except for the central hub and the plurality of spokes.

5. The drain stopper and strainer of claim 1, wherein the cap comprises an upper portion that is visible in the kitchen sink while installed in the kitchen sink and a lower portion that comprises a tube that has a bore defined by interior threads, wherein the open-close mechanism has exterior threads on its upper end, and wherein the upper end of the open-close mechanism is threaded into the bore in the tube in the cap.

6. The drain stopper and strainer of claim 5, wherein the cap seal has a frustoconical shape that has an open small end and an open large end relative to the small end, wherein the tube has a groove around its circumference, and wherein the small end is received in the groove.

7. The drain stopper and strainer of claim 6, wherein the strainer element comprises a hollow cylinder having an inside wall and top and bottom ends, wherein the top end has the sealing surface for receiving the cap seal, and wherein the large end of the cap seal presses against the sealing surface while the open-close mechanism is in its closed position.

8. The drain stopper and strainer of claim 7, wherein the bottom end of the strainer element comprises a central hub having an opening for receiving the lower end of the open-close mechanism, and wherein the bottom end comprises a perforated plate so that the strainer element functions as a strainer basket.

9. The drain stopper and strainer of claim 7, wherein the bottom end of the strainer element comprises a central hub having an opening for receiving the lower end of the open-close mechanism, wherein the bottom end further comprises a plurality of spokes that extend between the central hub and the inside wall of the hollow cylinder, and wherein the bottom end of the strainer element is open except for the central hub and the plurality of spokes.

10. The drain stopper and strainer of claim 1, wherein the strainer element comprises a hollow cylinder having an inside wall and top and bottom ends, wherein the top end has the sealing surface for receiving the cap seal while the open-close mechanism is in its closed position, wherein the bottom end comprises a central hub having an opening for receiving the lower end of the open-close mechanism, and wherein the bottom end comprises: (1) a perforated plate so that the strainer element functions as a strainer basket or (2) a plurality of spokes that extend between the central hub and the inside wall of the hollow cylinder without a perforated plate so that the strainer element does not function as a strainer basket.

11. The drain stopper and strainer of claim 10, wherein the lower end of the open-close mechanism has a ball-and-spring detent mechanism, wherein the lower end of the open-close mechanism and the ball-and-spring detent mechanism are designed and sized for the ball-and-spring detent mechanism to pass through the opening in the central hub in the bottom end of the strainer element and to thereby engage the open-close mechanism with the strainer element.

12. The drain stopper and strainer of claim 10, wherein the open-close mechanism is a push-type mechanism.

13. The drain stopper and strainer of claim 12, wherein the cap seal does not press downwardly on the flanged drain fitting while the open-close mechanism is in the closed position.

14. The drain stopper and strainer of claim 13, wherein the open-close mechanism is connected to the strainer by an easy-connect mechanism.

15. A drain stopper and strainer for a kitchen sink having a drain opening and a flanged drain fitting attached to the kitchen sink at the drain opening, the drain stopper and strainer comprising:

an open-close mechanism having upper and lower ends and open and closed positions;

a cap engaged with the upper end of the open-close mechanism;

a cap seal engaged with the cap;

a strainer element engaged with the lower end of the open-close mechanism by an easy-connect mechanism, wherein the easy-connect mechanism allows a user to remove the strainer from the open-close mechanism for cleaning the strainer and to reconnect the strainer to the open-close mechanism without the use of a tool, and wherein the strainer element is designed and sized to be sealed with the flanged drain fitting; and an annular seal engaged with the strainer element, wherein the annular seal is designed and sized to prevent water from flowing through an annular space defined between the strainer element and the flanged drain fitting, wherein the cap, the cap seal, the open-close mechanism, the strainer and the annular seal form a unitary assembly that can be pushed into and pulled out of the flanged drain fitting, wherein the unitary assembly is designed and sized to rest in the flanged drain fitting without otherwise being connected to the flanged drain fitting, and wherein the cap and the cap seal are above the strainer while in the flanged drain fitting.

16. The drain stopper and strainer of claim 15, wherein the cap seal does not press downwardly on the flanged drain fitting while the open-close mechanism is in the closed position.

17. The drain stopper and strainer of claim 16, wherein the cap seal presses against the strainer while the open-close mechanism is in the closed position, thereby providing a water-blocking seal for retaining water in the sink, wherein the water-blocking seal is at or below a lowermost inside surface of the sink.

18. The drain stopper and strainer of claim 15, wherein the strainer element has a sealing surface, wherein the cap seal seals against the sealing surface of the strainer element, wherein the sealing surface of the strainer element is inside the flanged drain fitting while in operation.

19. A drain stopper for a kitchen sink having a drain opening and a flanged drain fitting attached to the kitchen sink at the drain opening, wherein the flanged drain fitting comprises a tube having an inside wall, a first end having a perimeter, a drain flange that extends radially from perimeter of the first end for retaining the flanged drain fitting in the kitchen sink, the drain stopper comprising:

an open-close mechanism having upper and lower ends and open and closed positions;

a cap engaged with the upper end of the open-close mechanism, wherein the cap does not have holes through which water can pass;

a cap seal engaged with the cap;

a strainer engaged with the lower end of the open-close mechanism, wherein the strainer comprises a hollow cylinder having top and bottom ends, wherein the top end is open, wherein the bottom end has either a first structure for providing small openings or a second structure for providing large openings, wherein the strainer is designed and sized to allow water to drain from the kitchen sink through the strainer, and wherein the strainer is designed and sized to be sealed against the inside wall of the flanged drain fitting; and an annular seal engaged with the strainer, wherein the annular seal is designed and sized to seal against the inside wall of the flanged drain fitting, thereby sealing the strainer with the flanged drain fitting for preventing water from draining through an annular space defined between the strainer and the inside wall of the flanged drain fitting, wherein the cap seal is designed and sized to seal against the top end of the strainer, wherein the seal between the cap seal and the top end of the strainer is inside of the inside wall of the tube of the flanged drain fitting, wherein the cap and the cap seal are designed and sized to retain water in the kitchen sink while the open-close mechanism is in the closed position and to allow water to drain from the kitchen sink while the open-close mechanism is in the open position, wherein the cap, the cap seal, the open-close mechanism, the strainer and the annular seal comprise a unitary assembly while the drain stopper is assembled to make an assembled drain stopper, wherein the assembled drain stopper is designed and sized to fit within the flanged drain fitting, wherein the assembled drain stopper is not designed or sized to cover or rest on the drain flange, wherein the assembled drain stopper is not designed to be threadedly engaged with the flanged drain fitting, wherein the cap is the uppermost component in the assembled drain stopper while in operation, wherein the cap seal is engaged with a lower portion of the cap, wherein the strainer is the lowermost component in the assembled drain stopper, wherein the strainer has a perimeter along its circumference, wherein the annular seal is engaged with the perimeter of the strainer, wherein the open-close mechanism extends between the cap and the strainer, wherein the assembled drain stopper is designed so that a user can: (1) push the assembled drain stopper into the flanged drain fitting, (2) operate the open-close mechanism to retain water in or drain water from the kitchen sink without removing the assembled drain stopper from the flanged drain fitting, (3) pull the cap and thereby remove the assembled drain stopper from the flanged drain fitting so that the user can clean the strainer, and (4) push the assembled drain stopper back into the flanged drain fitting.

20. The drain stopper and strainer of claim 19, wherein the first structure in the strainer comprises a perforated plate having a central opening for receiving the open-close mechanism.

21. The drain stopper and strainer of claim 19, wherein the second structure in the strainer comprises a central hub and a plurality of spokes that extend between the central hub and an inside surface in the strainer.

22. The drain stopper and strainer of claim 19, wherein the open-close mechanism is not threadedly engaged with the strainer.

23. The drain stopper and strainer of claim 19, wherein the open-close mechanism is held in the strainer by a ball-and-spring detent mechanism.

24. The drain stopper and strainer of claim 19, wherein the first and second structures in the strainer have a central opening for receiving the lower end of the open-close mechanism, and wherein the open-close mechanism is held in the strainer by a ball-and-spring detent mechanism.

25. The drain stopper and strainer of claim 19, wherein the open open-close mechanism has a longitudinal axis, and wherein the cap, the cap seal and the strainer in the assembled drain stopper are radially symmetrical about the longitudinal axis in the open and in the closed positions.

26. The drain stopper and strainer of claim 19, wherein the first structure of the strainer comprises a perforated or screen structure, and wherein the second structure comprises a central hub and a plurality of spokes and does not have a perforated or screen structure extending between or attached to the plurality of spokes so that a strainer with the second structure does not function as a strainer basket.

27. The drain stopper and strainer of claim 26, wherein the central hub in the first and second structures in the strainer have a central opening for receiving the lower end of the open-close mechanism, wherein the lower end of the open-close mechanism has a ball-and-spring detent mechanism, and wherein the open-close mechanism is held in the strainer by the ball-and-spring detent mechanism.

* * * * *